US005560079A

United States Patent [19]

Jeynes

[11] Patent Number: 5,560,079

[45] Date of Patent: Oct. 1, 1996

[54] DOOR CLOSERS

[75] Inventor: Roger H. Jeynes, Quinton, Great Britain

[73] Assignee: Samuel Heath & Sons PLC, Birmingham, Great Britain

[21] Appl. No.: 313,199

[22] PCT Filed: Jul. 1, 1993

[86] PCT No.: PCT/GB93/01383

§ 371 Date: Nov. 8, 1994

§ 102(e) Date: Nov. 8, 1994

[87] PCT Pub. No.: WO94/01648

PCT Pub. Date: Jan. 20, 1994

[30] Foreign Application Priority Data

Jul. 4, 1992 [GB] United Kingdom ..... 9214270

[51] Int. Cl.[6] ..... E05F 1/08

[52] U.S. Cl. ..... 16/80; 16/82

[58] Field of Search ..... 16/80, 71, 76, 16/72, 82, 83, DIG. 17; 292/340, 341.12, 341.15, 341.18, DIG. 15

[56] References Cited

U.S. PATENT DOCUMENTS

| | | | |
|---|---|---|---|
| 925,184 | 6/1909 | Hess | 16/83 |
| 3,975,791 | 8/1976 | Hettich et al. | 16/72 |
| 4,110,867 | 9/1978 | Gwozdz | 16/82 |
| 4,295,245 | 10/1981 | Malcom | 16/80 |

FOREIGN PATENT DOCUMENTS

| | | |
|---|---|---|
| 1301117 | 7/1962 | France . |
| 2207106 | 8/1973 | Germany . |

OTHER PUBLICATIONS

International Search Report—Application No. PCT/GB 93/01383—Oct. 5, 1993.

*Primary Examiner*—Chuck Y. Mah
*Attorney, Agent, or Firm*—Webb Ziesenheim Bruening Logsdon Orkin & Hanson P.C.

[57] ABSTRACT

A door closer of the door check type includes a housing (10) for assembly with a door and supporting a pivotally mounted lever (21) and driving spring member (32) arranged to drive the lever (21) in an operative direction, and keep member (40) for assembly with a door frame to be engaged by said lever (21) and cooperate therewith to pull the door towards the door frame. The housing (10) includes an elongate body (15) which houses the driving spring (32) and a mounting plate (11) at one end of the body (15) whereby the housing body (15) may be mounted within the thickness of the door with the mounting plate (11) secured at an edge face thereof. The keep member (40) includes a keep body (44) which defines a recess (43) adapted to receive the lever (21) and a mounting flange (41) whereby the keep body (44) may be recessed into the door frame with the mounting flange (41) secured at an edge face of the door frame which is presented towards the edge face of the door at which the housing body (15) is mounted.

7 Claims, 2 Drawing Sheets

FIG 3
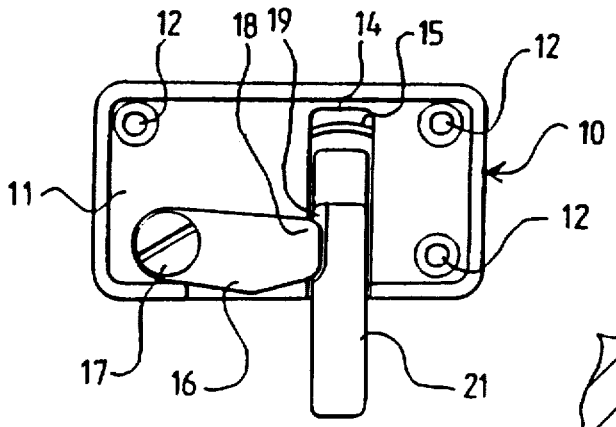
FIG 4
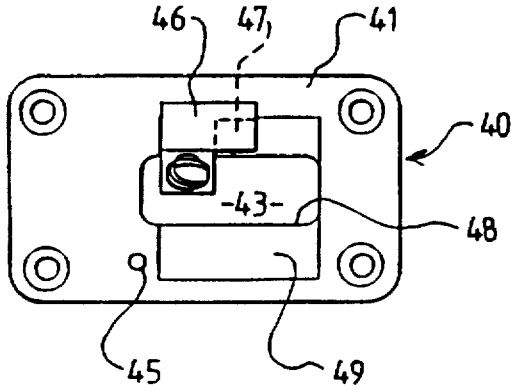
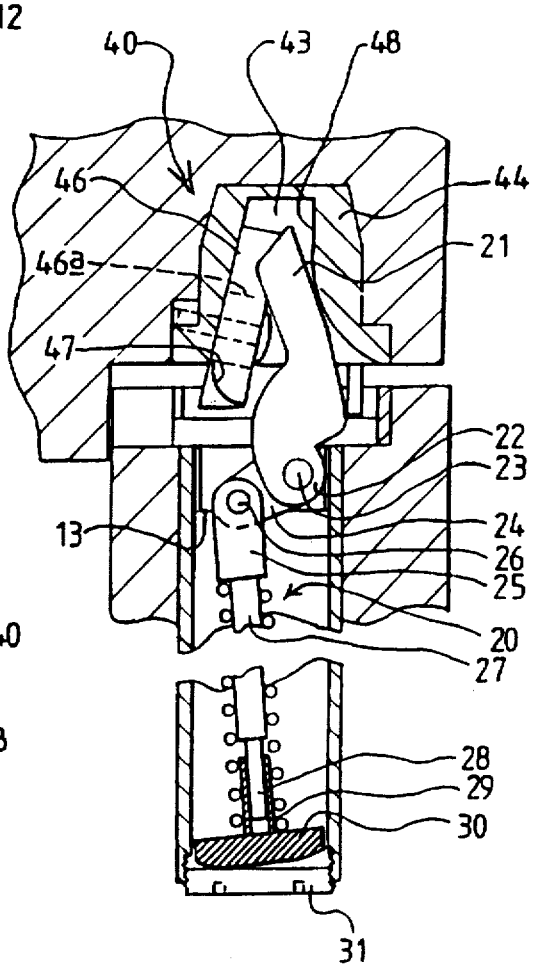
FIG 5

DOOR CLOSERS

BACKGROUND OF THE INVENTION

This invention relates to door closers of the kind, sometimes known as door checks, which operate during the final pan of the closure movement of a door towards the associated door frame for the purpose of ensuring that the door closes properly and optionally is held in a closed position. Such closers may be employed alone or in combination with a closer device which operates over substantially the full range of closing movement, i.e. at least up to point at which the door check type closer takes over.

Conventional door check type closers are designed for mounting on the face of a door and usually incorporate a spring driven arm with a relatively large roller which protrudes a significant distance from the door so as to be visually obtrusive, and co-operates with a keep member installed on the door frame, the keep member affording a part which intercepts the roller as the door is closed towards the door frame.

DE-A-2207106 discloses such a door-check type closer which includes a housing designed for mounting within the thickness of a door at an edge face thereof and having a spring-driven arm which protrudes from the housing and is adapted to engage a trip face provided on an associated keep member adapted for mounting in the door frame, engagement of the arm with the trip face as the door is moved to its position of closure relative to the frame displacing the arm from a first position, in which it extends obliquely from the housing and is retained by the driving spring, through an over-centre position so that the spring then drives the arm to a second position in which it extends away from the door generally perpendicular to the edge face at which the housing is installed. When the door is opened, the keep member acts on the arm to return it to its first position.

However, it is possible for the arm to be displaced, accidentally or otherwise, from said first position whilst the door is open, with consequent risk of damage and failure of the door to close properly if an attempt is then made to close the door whilst the arm is in its second position, and it is an object of the present invention to overcome such disadvantage.

SUMMARY OF THE INVENTION

According to the invention we provide a door closer of the door check type comprising a housing for assembly with a door and supporting a pivotally mounted lever and driving spring means arranged to drive said lever in an operative direction, and a keep member for assembly with a door frame to be engaged by said lever and co-operate therewith to pull the door towards the door frame, wherein said housing comprises an elongate body which houses said driving spring means and a mounting plate at one end of said body arranged transverse to the length of said body whereby the housing body may be mounted within the thickness of the door with said mounting plate secured at an edge face of the door, wherein said lever comprises an arm which is movable between a first or "primed" position in which it extends generally in or parallel to the plane of the mounting plate and protrudes laterally therefrom, and a second or "actuated" position in which it extends away from the mounting plate in a direction generally transverse to the plane thereof and within the lateral boundaries of the mounting plate, and wherein said keep member comprises a keep body, which defines a recess adapted to receive the lever, and a mounting flange adjacent to an open mouth of said recess whereby the keep body may be recessed into the door frame with the mounting flange secured at an edge face of said door frame which is presented towards said edge face of the door at which the housing body is mounted, characterised in that the housing supports a displaceable latch member which engages with said lever to hold said arm in the first position, and the keep member is formed or provided with striker means so arranged and adapted as to engage the latch member or a part carried thereby or connected thereto when the housing is brought into register with the keep member as the door is closed, and thereby disengage the latch member from the lever.

Conveniently, the latch member is carried by said mounting plate for movement in a direction generally parallel to the plane of the mounting plate and is biased by spring means into engagement with an abutment face formed on the lever.

Whilst the latch member may serve to hold the lever in said first position against the force of said driving spring means, it is preferred that such lever is movable through a dead centre position between said primed and actuated positions so that said driving spring means also holds the lever in said primed position until the lever is initially displaced by external forces past the dead centre position, the latch member serving as a safety catch to prevent such initial displacement of the lever inadvertently.

The striker means may comprise a pin which is preferably mounted on the keep member in a manner which permits of adjustment in a direction towards and away from the plane of the mounting flange.

Preferably, the keep member is formed or provided with trip means adapted and arranged in use to engage said lever as the housing is brought into register with the keep member and displace said lever from its primed position and past its dead centre position, allowing the lever then to be driven to its actuated position and engage a reaction face afforded by the keep member, the lever bearing against said reaction face to draw the door towards the door frame.

Preferably, the trip means comprises a cam face for engagement with said lever and the cam face is preferably formed on a trip member which is adjustably secured to the keep body for movement in a direction towards and away from the plane of the mouth of the recess.

The invention also resides in a door and frame assembly fitted with such a door closer.

BRIEF DESCRIPTION OF THE DRAWINGS

These and other features of the invention will now be described by way of example with reference to the accompanying drawings wherein:

FIG. 3 is a top plan view of the housing substantially on the line III—III of FIG. 1;

FIG. 4 is an underneath plan view the keep member substantially on the line IV—IV of FIG. 1; and FIG. 5 is a section similar to that of FIG. 2 but with the housing and keep assembly engaged with one another in the position adopted in use when the door is closed.

DETAILED DESCRIPTION OF THE INVENTION

Figure 1:
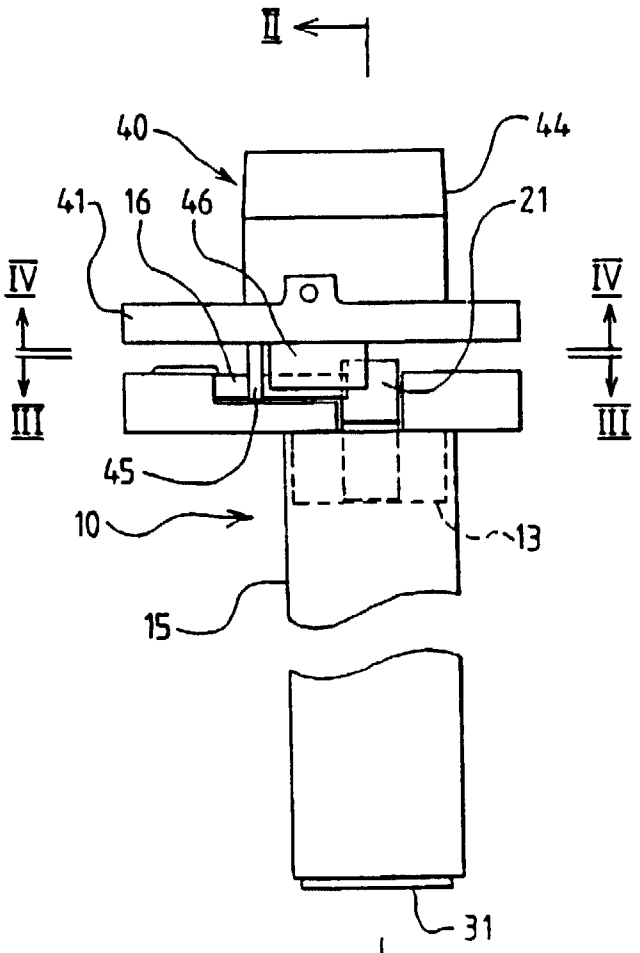
FIG. 1 shows a front view of one embodiment of door closer with the housing and keep member in a position as adopted just prior to their interengagement when installed.

Referring firstly to FIG. 1, the illustrated embodiment comprises a housing assembly 10 for installation in a door (D) and a keep assembly 40 for installation in a door frame (F).

Figure 2:
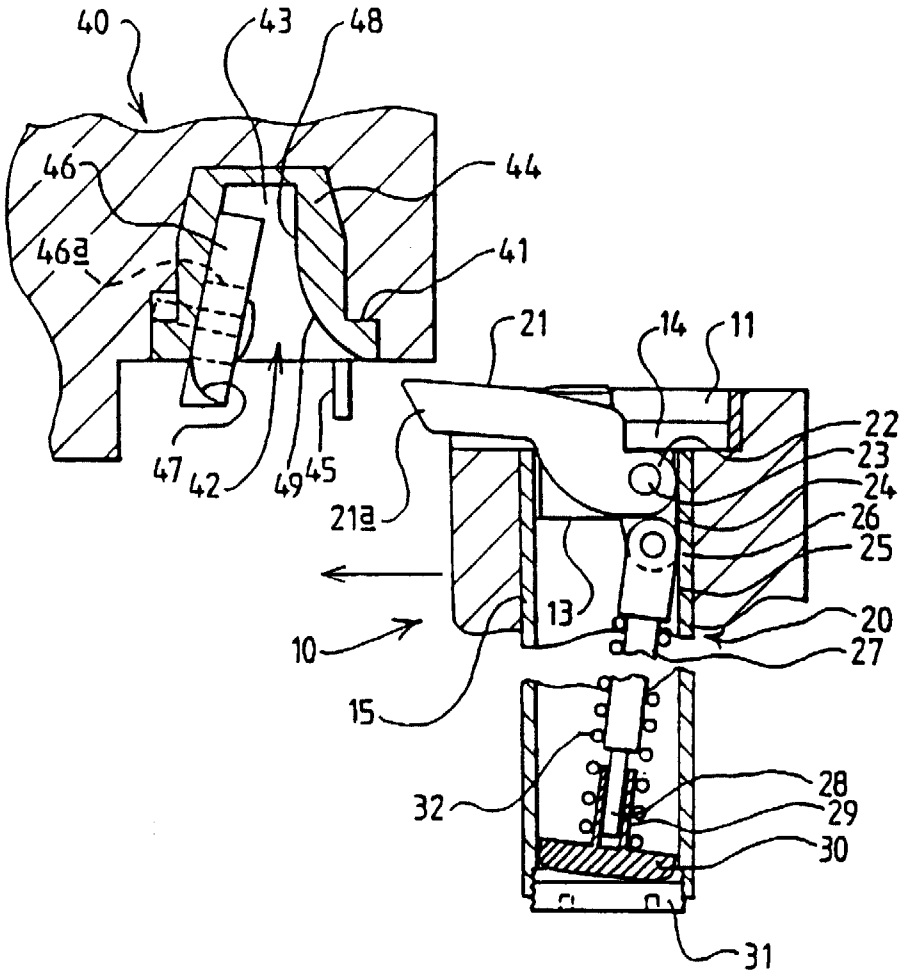
FIG. 2 shows a vertical section on the line II—II of FIG. 1.

The housing assembly 10 comprises a mounting plate 11 which affords screw holes 12 and on one side a boss 13 which carries an elongated tubular body 15. The housing assembly 10 houses an operating mechanism 20 which includes a lever arm 21 which is pivotally mounted within a slot 14 which extends through the mounting plate 11 and the boss 13. The lever arm 21 is movable between a first position, as shown in FIGS. 1 to 3, in which it projects laterally from the mounting plate 11 so as to protrude slightly beyond the face of the door (D). It will be understood that the mounting plate 11 is recessed into the edge face of the door and a small cut-out is formed to accept the lever arm. It is particularly to be noted that the extent to which the lever arm 21 projects beyond the face of the door is minimal.

The lever arm 21 includes a trunnion 22 whereby it is mounted on a pivot pin 23 secured to the boss 13 and extending across the slot 14. The trunnion 22 affords a lug 24 which is connected to a clevis 25 by means of pin 26. The clevis is secured to a rod 27 which extends along the length of the tubular body 15 and terminates in an extension 28 of reduced diameter which is received slidably within a sleeve 29 carried by a disc 30. The disc 30 bears on a plug 31 which is threadably received within the lower end of the tubular body 15 so as to be axially adjustable.

A strong compression spring 32 is mounted on the rod 27 and over the sleeve 29 so as to act between the disc 30 and the clevis 25. It will be appreciated that axial adjustment of the plug 31 adjusts the compression of the spring 32 so as to vary the force exerted on the lever arm.

In the position as illustrated particularly in FIG. 2, the force exerted by the spring 32 acts to hold the lever arm 21 in the illustrated position, which is close to a dead centre position so that the mechanism is "primed", in response to an initial displacement of the lever arm 21 to bring the mechanism past the dead centre position, to drive the lever arm into the "actuated" position shown in FIG. 5.

A safety catch is provided in the illustrated embodiment to retain the lever arm 21 in such "primed" position whilst the door is open, in order to guard against accidental displacement of the lever arm in such a manner that it is driven to its actuated position before the door is closed. The safety catch comprises a lever 16 which is pivotally mounted on the mounting plate 11 by means of a pivot screw 17 with an associated torsion spring (not shown) which biases the lever into the position illustrated in FIG. 3 in which the end 18 of the lever engages an abutment face 19 formed as a recess in the lever arm 21.

The keep assembly 40 comprises a mounting plate 41 which is formed as a flange which extends around a mouth 42 of a recess 43 defined by a hollow body 44 which is disposed to one side of the mounting plate 41.

A striker pin 45 is arranged to project from the mounting plate 41 at the side opposite the body 44, at such a position that, when installed, as the mounting plate 11 of the housing assembly 10 approaches the mounting plate 41, the pin 45 engages the lever 16 so as to disengage the end 18 thereof from the abutment face 19 of the lever arm 21, thereby readying the lever arm 21 for movement to its actuated position.

However, in the illustrated embodiment the lever arm 21 remains in the "primed" position, by virtue of the over-centre action of the operating mechanism 20.

A trip member 46 is provided in the mouth 42 of the recess 43 to engage the nose 21*a* of the lever arm 21. The trip member 46 is formed with a cam face 47 which co-operates with the nose 21*a* of the lever arm 21 so as to pivot the lever arm 21 and move the operating mechanism 20 through its dead centre condition so that the spring 32 then acts to throw the lever arm 21 to its actuated position in which it extends away from the mounting plate 11, but within the lateral boundaries thereof.

In accordance with a preferred feature of the invention, the striker pin 45 and the trip member 46 are both positionally adjustable relative to the mouth 42 of the recess 43 in order to accommodate varying widths of gap between the edge face of the door and the opposite edge face of the door frame. This may be achieved, for example, by forming the pin 45 with a screw thread whereby it is adjustably received in a threaded hole in the mounting plate 41, whilst the trip member 46 may be in the form of a bar which is secured within the recess by means of a screw which extends through an elongated slot 46*a*, the cam face 47 being formed on a lateral extension of the bar.

In use, the keep assembly 40 is fitted into a recess formed in an edge face of the door frame which is presented towards the door opening, preferably at the top of the door frame between about 100 mm and about 200 mm from its hinged edge, and the housing assembly 10 is similarly fitted within a recess formed within the thickness of the door, preferably at the top edge of the door, so that when the door is in its position of closure relative to the door frame, the mounting plates 11 and 41 are in register.

The door may, if desired, also be equipped with an additional closer device of the kind which operates over substantially the entire range of movement of the door, for example of the kind disclosed and claimed in British Patent No. 2044840 or 2216181 so that the closer of the invention serves to augment the closing force provided by such closers. In a typical case the closer of the invention may be designed to provide a closing force in excess of 18 Nm, either alone or in combination with any other closer fitted to the door.

In use as the door approaches the door frame, pin 45 engages the lever 16 thereby displacing the latter out of contact with the abutment face 19 of the lever arm 21, so as to free the lever arm for movement from its primed position. Continued movement of the door then causes the nose 21*a* of the lever arm 21 to engage the cam face 47 so as to displace the lever arm upwardly and move the operating mechanism through its dead centre position, so that the arm is then thrust upwardly by the force of the spring 32 and into engagement with the reaction face 48 of the keep assembly. Bearing against the, fixed reaction face 48, the lever arm 21 then serves to pull the door inwardly of the door frame under the force of the spring 32 until the movement of the door is arrested by contact with the door frame.

The door is then held in its closed position by the lever arm 21, and any additional catch mechanism which may be fitted to the door.

When the door is opened manually, the lever arm 21 bears against the rounded face 49 of the keep assembly, whereby the lever arm is returned to its primed position before disengaging from the keep assembly, the operating mechanism again passing through its dead centre position, and the safety catch lever 16 returning, under the force of its associated biasing spring, to engage the abutment face 19 of the lever arm 21 as the safety catch lever 16 disengages from the pin 45.

Whilst in the illustrated embodiment the lever arm 21 is designed to engage the cam face 47 directly, it will be appreciated that the lever arm may carry one or more rollers whereby it engages the cam face 47 and/or the reaction face 48 and rounded face 49.

Instead of providing for separate adjustment of the position of the cam face 47 and the pin 45, the keep assembly may alternatively support an inner housing which is adjustable relative to the hollow body, such adjustable inner housing being formed or provided with said cam face and pin or the equivalent thereof.

It will be appreciated that the embodiment illustrated in the accompanying drawings is merely one example of a closer in accordance with the invention, and that many variations on the design are possible. For example, the safety catch lever 16 may be replaced by a laterally movable pin adapted to enter into a corresponding hole or recess formed in the lever arm 21 or a part carried thereby or connected thereto; the spring 32 may be replaced by an hydraulic or pneumatic actuator; and the end plug 31 need not be axially adjustable in any case where the closer is required to afford a predetermined, invariable closing force.

The features disclosed in the foregoing description or the accompanying drawings, expressed in their specific forms or in terms of a means for performing the disclosed function, or a method or process for attaining the disclosed result, or a class or group of substances or compositions, as appropriate, may, separately or in any combination of such features, be utilised for realising the invention in diverse forms thereof.

I claim:

1. A door closer of the door check type comprising a housing (10) for assembly with a door and supporting a pivotally mounted lever (21,22,24) and driving spring means (32) arranged to drive said lever (21,22,24) in an operative direction, and a keep member (40) for assembly with a door frame to be engaged by said lever (21,22,24) and co-operate therewith to pull the door towards the door frame, wherein said housing (10) comprises an elongate body (20) which houses said driving spring means (32) and a mounting plate (11) at one end of said body (20) arranged transverse to the length of said body whereby the housing body (20) is adapted to be mounted within the thickness of the door with said mounting plate (11 ) secured at an edge face of the door, wherein said lever (21,22,24) comprises an arm (21) which is movable between a first position in which it extends generally in or parallel to the plane of the mounting plate (11) and protrudes laterally therefrom, and a second position in which it extends away from the mounting plate (11) in a direction generally transverse to the plane of said mounting plate and within the lateral boundaries of the mounting plate (11), and wherein said keep member (40) comprises a keep body (44), which defines a recess (43) adapted to receive the lever (21,22,24), and a mounting flange (41) adjacent to an open mouth of said recess (43) whereby the keep body (44) is adapted to be recessed into the door frame with the mounting flange (41) secured at an edge face of said door frame which is presented towards said edge face of the door at which the housing body is mounted, characterized in that the housing (10) supports a displaceable latch member (16) which engages with said lever (21,22,24) to hold said arm (21) in the first position, and the keep member (40) comprises striker means (45) so arranged and adapted as to disengage the latch member (16) from the lever when the housing (10) is brought into register with the keep member (40) as the door is closed.

2. A door closer according to claim 1 wherein the latch member (16) is carried by said mounting plate (11) for movement in a direction generally parallel to the plane of the mounting plate (11) and is biased by spring means into engagement with an abutment face (19) formed on the lever (21,22,24).

3. A door closer according to claim 2 wherein the striker means comprises a pin (45) which is mounted on the keep member (40) in a manner which permits of adjustment in a direction towards and away from the plane of the mounting flange (41).

4. A door closer according to claim 1 wherein the lever (21,22,24) is movable through a dead centre position between said first and second positions so that said driving spring means (32) also holds the lever in said first position until the lever (21,22,24) is initially displaced by external forces past the dead centre position, the latch member (16) serving as a safety catch to prevent such initial displacement of the lever inadvertently.

5. A door closer according to claim 4 wherein the keep member (40) comprises trip means (46) adapted and arranged in use to engage said lever (21,22,24) as the housing (10) is brought into register with the keep member (40) and displace said lever (21,22,24) from its first position and past its dead centre position, allowing the lever (21,22, 24) then to be driven to its second position and engage a reaction face (48) afforded by the keep member (40), the arm (21) of the lever (21,22,24) bearing against said reaction face (48) to draw the door towards the door frame.

6. A door closer according to claim 5 wherein the trip means (46) comprises a cam face (47) for engagement with said lever (21,22,24) and formed on a trip member (46) which is adjustably secured to the keep body (44) for movement in a direction towards and away from the plane of the mouth of the recess (43).

7. A door and frame assembly fitted with a door closer according to claim 1.

* * * * *

UNITED STATES PATENT AND TRADEMARK OFFICE

CERTIFICATE OF CORRECTION

PATENT NO. : 5,560,079
DATED : October 1, 1996
INVENTOR(S) : Roger H. Jeynes

It is certified that error appears in the above-indentified patent and that said Letters Patent is hereby corrected as shown below:

Column 1 Line 7 "pan" should read --part--.

Signed and Sealed this

Tenth Day of December, 1996

*Attest:*

Bruce Lehman

BRUCE LEHMAN

*Attesting Officer*

*Commissioner of Patents and Trademarks*